US005529045A

United States Patent [19]

Bauer et al.

[11] Patent Number: 5,529,045

[45] Date of Patent: Jun. 25, 1996

[54] RECIPROCATING INTERNAL COMBUSTION ENGINE

[75] Inventors: Lothar Bauer, Köln; Werner Lemme, Rösrath; Kai Tedsen, Orfgen; Reinhard Rechberg, St. Augustin, all of Germany

[73] Assignee: Köckner-Humboldt-Deutz AG, Germany

[21] Appl. No.: 396,914

[22] Filed: Mar. 1, 1995

[30] Foreign Application Priority Data

Mar. 3, 1994 [DE] Germany ..... 44 06 986.3

[51] Int. Cl.[6] ..... F01M 13/02; F02F 11/00

[52] U.S. Cl. ..... 123/572

[58] Field of Search ..... 123/572, 573, 123/574, 195 AC

[56] References Cited

U.S. PATENT DOCUMENTS

| | | | |
|---|---|---|---|
| 1,893,183 | 1/1933 | Sleffel | 123/572 |
| 1,922,640 | 8/1933 | Rosner | 123/572 |
| 4,167,164 | 9/1979 | Bachmann | 123/574 |
| 4,549,520 | 10/1985 | Tamba et al. | 123/573 |
| 4,580,543 | 4/1986 | Aoki | 123/573 |
| 4,945,887 | 8/1990 | Sakurai et al. | 123/573 |
| 5,090,393 | 2/1992 | Holch | 123/574 |
| 5,123,385 | 6/1992 | Sado et al. | 123/572 |
| 5,257,674 | 11/1993 | Okui et al. | 123/195 AC |
| 5,285,754 | 2/1994 | Bell | 123/573 |

*Primary Examiner*—Marguerite McMahon
*Attorney, Agent, or Firm*—Hardaway Law Firm; Charles L. Schwab

[57] ABSTRACT

A reciprocating internal combustion engine having a cylinder crankcase and a ventilation device for said crankcase, which ventilation device is in fluid flow relation with an oil-gas distribution line in a cylinder head.

The fluid flow connections between the ventilation device (3) and the interior of the cylinder crankcase (1) and between the ventilation device (3) and the oil-gas distribution line is effected solely by flow passages internal to the engine.

11 Claims, 3 Drawing Sheets

RECIPROCATING INTERNAL COMBUSTION ENGINE

TECHNICAL FIELD

This invention relates to a reciprocating internal combustion engine having a cylinder crankcase, a cylinder head and a ventilation device for the cylinder crankcase.

BACKGROUND OF THE INVENTION

Crankcase ventilations serve for the purposeful removal of gases that travel along the pistons into the interior of the crankcase. These gases are not to be released into the environment but must be supplied to the combustion process. Because they contain lubricating oil, they are conveyed to the intake valves, by which means the seats of said valves are lubricated.

By means of the connection of the intake ducts, in which vacuum prevails, to the crankcase, vacuum can be produced in the crankcase, which can lead to the introduction of contamination into the crankcase. For this reason, the pressure in the crankcase is held constant at a certain pressure by a ventilation valve.

In European Patent EP-B-0 251 159, there is described a reciprocating internal combustion engine having a ventilation device, which is provided in the form of a ventilation valve arranged at the end of the cylinder crankcase opposite the flywheel end. The ventilation valve is connected by way of tubes to the interior of the cylinder crankcase and to an oil-gas distribution line in the cylinder head. While this ventilation device is capable of functioning, it is rather costly in construction.

OBJECTS AND SUMMARY OF THE INVENTION

It is an object of the invention to create a functionally reliable ventilation device for the cylinder crankcase of a reciprocating internal combustion engine, which ventilation device is functionally reliable and simultaneously simple in its structure.

The use of cross flow connections exclusively internal to the engine for the connection of the interior of the cylinder crankcase to the ventilation valve and the oil-gas distribution line in the cylinder head avoids the expense for the fabrication and assembly of external lines, which furthermore always have leakage problems. What is more, there ceases to be any danger of a loss of the connecting line and thus of the failure of the intake valve lubrication.

It is advantageous that the ventilation device has a housing having an upper part and a lower part, which housing is part of a front cover. In this fashion, an integration of the ventilation device in the front cover is achieved, which front cover in turn has a direct flow connection to the interior of the cylinder crankcase.

Also advantageous is that the lower part has a calming space and a ventilation space, which are connected by means of a hole controlled by a ventilation valve disk, the calming space being in direct flow connection with the interior of the cylinder crankcase while the ventilation space is in flow connection to the oil-gas distribution line via a recess in the crankcase and a crankcase hole as well as via a cylinder head hole. In this fashion, the leading of oil gases from the cylinder crankcase to the oil-gas distribution line via exclusively internal holes is insured. All external connecting lines with the associated danger of leakage are done away with by this improvement.

It has proved advantageous that a pocket is integrally cast in a seal surface of the end of the cylinder crankcase opposite the flywheel end, and that the crankcase hole is arranged parallel to the end opposite to the flywheel end, opening into the recess, and coaxially to the cylinder hole. Because the recess is castable without additional expense and the crankcase hole is made in a principal machining direction, the fabrication expense for the ventilation cross sections is slight. The cleaning of the crankcase hole after its fabrication is facilitated by the fact that the crankcase hole runs out into the recess. The cast recess is shaped in a hydraulically favorable way so that the hydraulic resistance of the ventilation line is low.

It is advantageous that there is provided, between cylinder crankcase and cylinder head, a cylinder head gasket, which has a gasket hole for oil gases, and that the cylinder head hole is made larger in diameter than the gasket hole and the gasket hole is made larger than the crankcase hole. In this fashion, leading of the oil gases with little throttling is effected even if there is a slight lateral misalignment of cylinder head hole, gasket hole and crankcase hole.

It is advantageous that there is provided on the lower part an integrally cast hose connector, which is closed off in the case of a naturally aspired engine and is in flow connection to the suction side of a turbocharger in the case of a supercharged engine, while at the same time the crankcase hole is closed off by a supercharged cylinder head without a cylinder head hole. Because the charge air pressure in the case of the supercharged engine is higher than the oil-gas pressure in the crankcase, no oil gas can get into the intake ducts on the way via the oil-gas distribution line. For this reason, according to the invention, the oil gas is led to the suction side of the exhaust gas turbocharger, where, by means of passing through the turbocharger, it is uniformly mixed with the intake air and in this fashion uniformly distributed to the several cylinders. By this means, lubrication of all intake valve seats is insured even in the case of the supercharged engine. The absence of a cylinder head hole in the supercharged cylinder head causes an automatic closing of the crankcase hole, by which means a backflow of charge air into the crankcase is prevented.

It has also proved advantageous that the upper part is made as a plastic can that can be slid into a cylindrical guide of the lower part, and that an 0-ring is provided in order to seal the upper part and lower part, which O-ring is retained on the upper part by means of an overturned lip. A reliable sealing of the ventilation device is insured by means of the arrangement of an O-ring, and easy assembly is achieved by means of the retaining lip.

Also advantageous is that the upper part has a cylindrical cover guide into which a cover can be pressed, by means of which cover a membrane is sealingly fixable, said membrane guiding the ventilation valve disk connected to it and actuating said disk against a compression spring. This making of the upper part insures easy assembly of the membrane, which acts simultaneously as a sealing and guiding element and thus occasions a low construction cost.

By means of an advantageous development of the invention in which the cover has a ventilation hole that is protected against contamination by means of a downward pointing cap, it is insured that the membrane can move freely and is not hindered in its movement by means of an air cushion on its back side. Penetration of contamination or water splash into the ventilation hole is prevented by means of the position of the cap according to the invention.

By means of an advantageous development of the invention in which the upper part and/or the lower part have pockets at the periphery as a disassembly aid for the upper part, easy disassembly of the upper part and thus replacement of said upper part, if necessary, is possible with the aid of an assembly tool.

Also advantageous is that a bypass hole to the ventilation hole is provided in a wall separating the calming space from the ventilation space. This insures a minimum oil-gas quantity that is required for the reliable lubrication of the intake valve seats, even in the case of a closed ventilation valve.

BRIEF DESCRIPTION OF THE DRAWINGS

Further features of the invention can be understood from the following description and from the drawings, wherein.

DETAILED DESCRIPTION OF THE DRAWINGS

Figure 1:
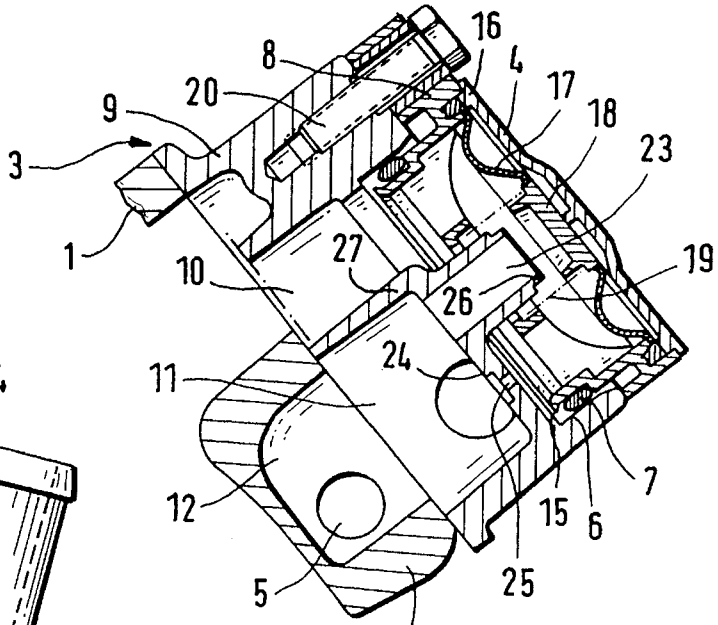
FIG. 1 is a section taken along the line I—I in FIG. 2.
Figure 2:
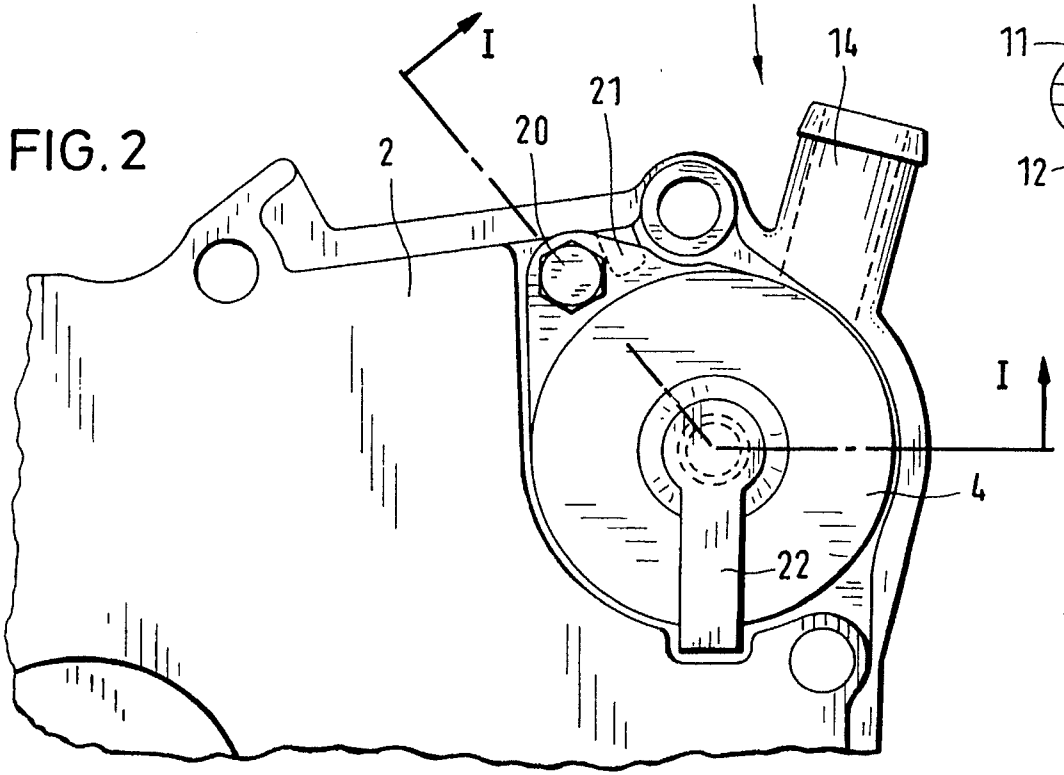
FIG. 2 is a top view of the ventilation device 3.
Figure 3:
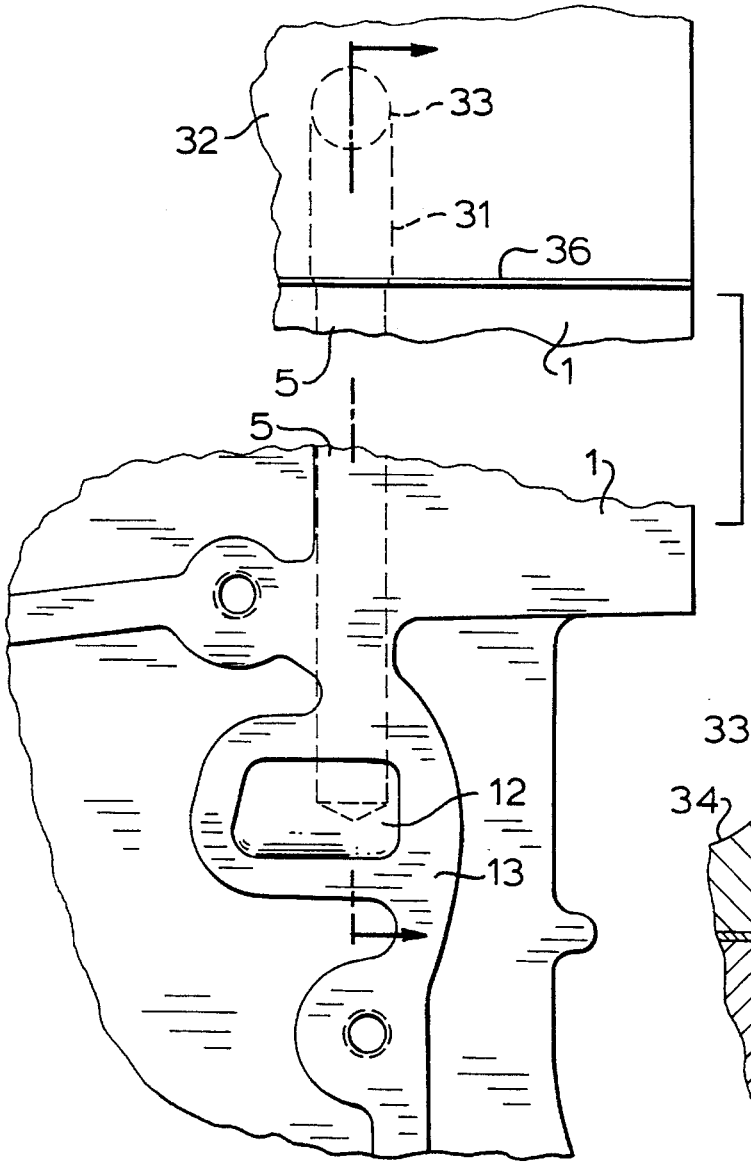
FIG. 3 is a detail view of the cylinder crankcase in the region of the ventilation device.
Figure 3A:
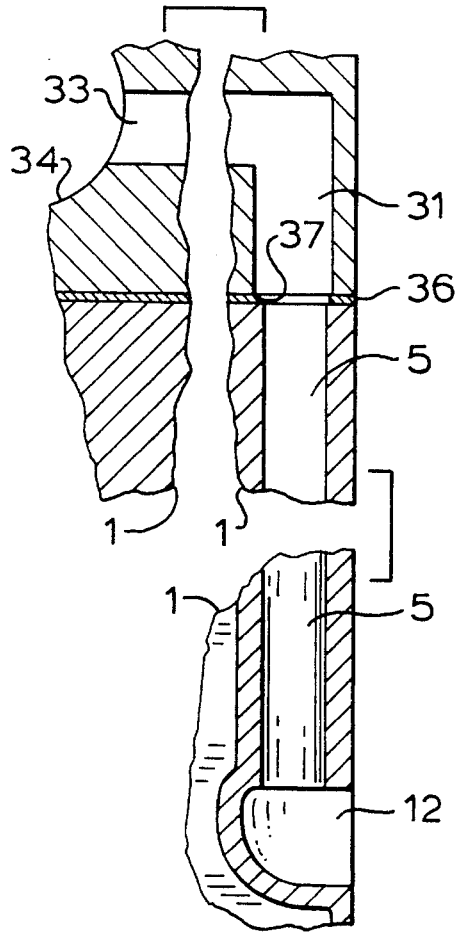
FIG. 3*a* is a section through the recess 12 and the crankcase hole 5 from FIG. 3.
Figure 4:
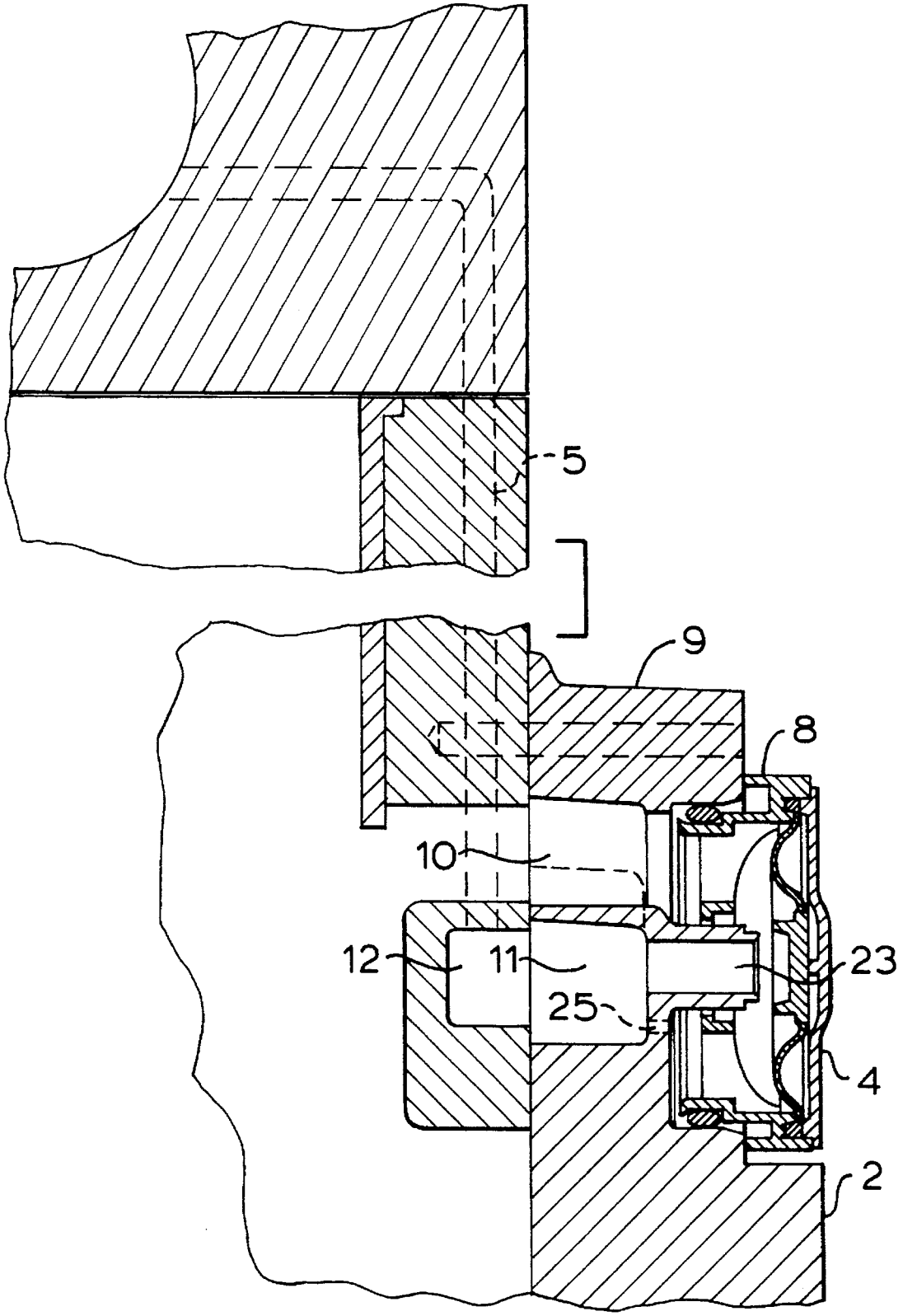

FIG. 1 shows a section through the ventilation device 3, which has an upper part 8 and a lower part 9. The upper part 8 is a substantially circular plastic body that is insertable into a likewise circular guide 6 of the lower part 9. The upper part 8 has a circular cover guide 16, into which a slightly oversized circular cover 4 can be pressed. Below the cover 4 there is a membrane 17, which is firmly pressed into a groove in the region of the cover guide 16 by means of the cover 4. The membrane 17 serves to actuate and guide a ventilation valve disk 18. The disk cooperates with a valve seat 26, which is arranged coaxially in the lower part 9. The ventilation valve disk 18 is loaded by a compression spring 19, which is supported on a brace belonging to the upper part 8 and seeks to lift the ventilation valve disk 18 away from its valve seat 26. Located in the cover 4 is a ventilation hole, not illustrated, which is protected against contamination and water splash by a cap 22. The ventilation hole serves to ventilate the space between the membrane 17 and the cover 4. The upper part 8 is sealed to the lower part 9 by an O-ring 7 and is connected to the lower part by a screw 20. The O-ring 7 is located in a groove having a lip 15, which retains the O-ring. The upper part 8 with the cover 4 and the membrane 17 with the ventilation valve disk 18 are fabricated of plastic.

In contrast thereto, the lower part 9, as part of the front cover 2, consists of light metal. It has a calming space 10 and a ventilation space 11, which are separated by a wall 24 and connected by a hole or opening which forms a port 23. The hole 23 is located in a sleeve 27, and the valve seat 26 is arranged on the end of the sleeve and faces toward the ventilation valve disk 18. Furthermore, a bypass hole 25 is provided in the wall 24. As an aid to disassembly of the upper part 8 from the lower part 9, a pocket 21 is formed in the lower part 9 at the periphery of the upper part 8.

The calming space 10 is in direct flow connection with the interior of the cylinder crankcase 1, and the ventilation space 11 is connected to a recess 12 into which a crankcase hole 5 opens. The crankcase hole goes over into a coaxial cylinder head hole 31 in the cylinder head 32, which cylinder head hole creates a connection to the oil-gas distribution line 33 in the cylinder head. Between the cylinder head and the cylinder crankcase 1 there is a cylinder head gasket 36, in which an appropriate hole or opening 37 is provided for the passage of the oil gases. The diameters of the crankcase hole 5, the opening 37 in the cylinder head gasket, and the cylinder head hole 31 are made one step larger each time, in order in this fashion to give rise to no throttling of the oil gases in case of a lateral misalignment. For the same reason, the recess 12 is shaped in a hydraulically favorable way. It is fabricated by casting in a seal surface 13 of the cylinder crankcase 1 at the end of said crankcase opposite to a flywheel end, by which means a low-cost and hydraulically favorable shape can be effected.

The above-described ventilation device 3 is conceived for a naturally aspirated engine. The supercharged engine works with a hose connector 14, which is in flow connection with the ventilation space 11 of the lower part 9. The hose connector 14 is in flow connection with the suction side of an exhaust gas turbocharger. In the case of the supercharged engine, the cylinder head has no cylinder head hole, so that the crankcase hole 5 is closed off by means of the cylinder head.

The ventilation device according to the invention functions in the following way:

The gases containing lubricating oil vapors and droplets, penetrating into the interior of the cylinder crankcase during operation of the engine, pass via the front cover 2 into the calming space 10. There the larger oil droplets are separated. The ventilation valve disk 18 is normally lifted away from its valve seat 26 by the compression spring 19, so that the oil gases have free access, via the hole or port 23, to the ventilation space 11 and further, via the recess 12, the crankcase hole 5 and the cylinder head hole, to the oil-gas distribution line 33. The oil-gas distribution line 33 insures a uniform distribution of the oil gases to the individual intake ducts 34 of the cylinder head, by which means a uniform and adequate lubrication of the intake valve seats is insured. This is a prerequisite for a low-wear operation of the intake valves.

If a pipe vacuum should prevail in the intake ducts of the cylinder head, such vacuum propagates up to the membrane 17 and loads the membrane in such a sense as to close the ventilation valve disk. In this fashion, a vacuum is prevented from forming in the crankcase, by means of which vacuum contamination could penetrate into the interior of the crankcase via any leaks that may be present. The ventilation hole, not illustrated, in the cover 4 effects free movability of the membrane and thus enables the ventilation valve to function. By means of the bypass hole 25, a minimum oil-gas quantity flows into the intake ducts, even when the ventilation valve is closed, so that in any case a minimum lubrication of the intake valve seats is insured. The conveying of oil gas by use of internal cross sections and holes makes unnecessary the expense for additional lines and avoids the risk of oil leakage. By this improvement, fabrication and operation of the engine are rendered low in cost.

What is claimed is:

1. In an internal combustion engine having a cylinder crankcase (1) with a front end and an interior and a cylinder head with intake ducts 34 and an oil-gas distribution line 33 leading to said intake ducts, the combination comprising:

a front cover on said front end of said cylinder crankcase, a ventilation device including a housing having an upper part (8) and a lower part (9), said lower part being integrally formed with said front cover and including a wall (24) dividing said lower part into a calming space (10) and a ventilating space (11), said wall (24) including an opening (23) forming a port and a ventilating value disc in said ventilation device operable to control flow through said port, said calming space (10) having a fluid connection with said interior of said cylinder crankcase and said ventilating space (11) having a fluid flow connection with said oil-gas distribution line 33, and said connections being internal to the engine.

2. The internal combustion engine of claim 1 wherein said cylinder crankcase includes a recess (12) in free flow communication with said ventilating space (110 and a crankcase hole (5) connected to said recess (12), said cylinder head (32) including a cylinder head hole (31) aligned with and in fluid flow communication with said crankcase hole (5), said cylinder head hole (31) being connected to said oil-gas distribution line (33) thereby placing said ventilating space (11) in fluid communication with said oil-gas distribution line (33) in said cylinder head.

3. The internal combustion engine of claim 2 wherein said cylinder crankcase has a seal surface (13) at said front end in which said recess (12) is integrally cast and wherein said crankcase hole (5) is parallel to said seal surface (13).

4. The internal combustion engine of claim 2 and further comprising a head gasket 36 between said cylinder head and said cylinder crankcase, including a gasket hole (37) substantially aligned with said crankcase hole (5) and wherein said cylinder head hole is larger in diameter than said gasket hole and said gasket hole is larger in diameter than said crankcase hole (5).

5. The internal combustion engine of claim 1 wherein said lower part (9) includes a cylindrical guide (6) for said upper part (8), wherein said upper part includes an recessed lip (15) and further comprising an O-ring on said recessed lip (15) sealing said upper part (8) relative to said lower part (9).

6. The internal combustion engine of claim 1 and further comprising a cylindrical cover guide (16) on said upper part (8), a cover (4) press fit in said cover guide (16), a membrane (17) on said upper part (8) supporting said ventilation valve disk (18), a compression spring mounted on said upper part (8) and acting against said valve disk (18) to bias the latter in a direction away from said layer part (9).

7. The internal combustion engine of claim 6 wherein said cover has a ventilation hole and a downwardly pointing cap (22) protecting said ventilation hole against contamination.

8. The internal combustion engine of claim 1 wherein at least one of said upper and lower parts (8, 9) has a pocket (21) at the periphery of said upper part (8) facilitating disassembly of said parts.

9. The internal combustion engine of claim 2 wherein said wall (24) includes a bypass hole (25).

10. In an internal combustion engine having a cylinder crankcase with a front end and an interior and a cylinder head mounted on said cylinder crankcase and having an oil-gas distribution line leading to an intake duct, the combination comprising:

a front cover on said front end of said cylinder crankcase, a ventilation device including a housing having an upper part (18) and a lower part (9), said lower part (9) being integrally formed with said front cover, said ventilation device having a fluid flow connection with said interior of said cylinder crankcase and a fluid flow connection with said oil-gas distribution line, said connections being internal to said engine, said lower part (9) including a cylindrical guide (6) for said upper part (8) and said upper part (8) including a recessed lip (15) and an O-ring on said recessed lip (15) sealing said upper part (8) relative to said lower part (9).

11. In an internal combustion engine having a cylinder crankcase with a front end and an interior and a cylinder head with an oil-gas line leading to an intake duct, the combination comprising:

a front cover on said front end of said cylinder crankcase, a ventilation device including an upper part (8) and a lower part (9), said lower part (9) being integrally formed with said front cover and including a wall (24) dividing said lower part (9) into a calming space (10) and a ventilating space (11), said wall (24) including an opening (23) forming a port, said calming space being in free flow communication with said interior of said cylinder crankcase, said ventilation device further including a ventilation valve disk (18) operable to control flow through said port, passageways in said cylinder crankcase and cylinder head placing said ventilating space (11) in fluid communication with said oil-gas line (33) in said cylinder head and a bypass hole (25) in said wall (24).

* * * * *